US005179582A

United States Patent [19]

Keller et al.

[11] Patent Number: 5,179,582

[45] Date of Patent: Jan. 12, 1993

[54] EXPOSURE CONTROL CIRCUIT FOR X-RAY GENERATION

[75] Inventors: Thomas P. Keller, Camillus; William C. Greenway, Liverpool, both of N.Y.

[73] Assignee: S&S Inficon Inc., Liverpool, N.Y.

[21] Appl. No.: 871,233

[22] Filed: Apr. 20, 1992

[51] Int. Cl.[5] ..... H05G 1/38

[52] U.S. Cl. ..... 378/96; 378/97; 378/110; 378/112

[58] Field of Search ..... 378/96, 97, 101, 110, 378/109, 108, 111, 91, 112

[56] References Cited

U.S. PATENT DOCUMENTS

| | | | |
|---|---|---|---|
| 26,497 | 12/1868 | Splain | 378/96 |
| 2,122,222 | 6/1938 | Vingerhoets | 378/96 |
| 2,788,453 | 4/1957 | Lusted | 378/96 |
| 3,428,809 | 2/1969 | Daniels et al. | 378/98 |
| 3,792,267 | 2/1974 | Westerkowksy | 378/96 |
| 4,335,307 | 6/1982 | DeVries et al. | 378/111 |
| 4,358,684 | 12/1982 | Greiner et al. | 378/98 |
| 4,639,943 | 1/1987 | Heinze et al. | 378/96 |
| 4,796,286 | 1/1989 | Ochmann et al. | 378/110 |

*Primary Examiner*—Constantine Hannaher
*Assistant Examiner*—Don Wong
*Attorney, Agent, or Firm*—Wall and Roehrig

[57] ABSTRACT

An exposure control circuit captures an X-ray generator exposure time for a master exposure and replicates that time for subsequent exposures in a series. In one preferred circuit an read counter bank counts down clock pulses during the master exposure time, and then this count is held and is used by a write counter bank which counts up during subsequent exposures. A control circuit controls loading an enabling functions of the read and write counters. For the subsequent exposures, an output relay circuit terminates the X-ray generator exposure when the write counter bank reaches a predetermined count. This arrangement is used favorably with digital subtractive angiography (DSA).

7 Claims, 5 Drawing Sheets

| FIG. 2A | FIG. 2B | FIG. 2C |
|---|---|---|

EXPOSURE CONTROL CIRCUIT FOR X-RAY GENERATION

BACKGROUND OF THE INVENTION

This invention is directed to exposure control for an x-ray or similar radiographic system. The invention is more particularly concerned with a circuit that is used in conjunction with a phototimer or other automatic control element for an x-ray system to capture the x-ray generator exposure time and replicate that time on subsequent exposures.

In many areas of radiography where a series of exposures is needed, a phototimer or similar device is often used to control the exposure time of the x-ray generator. The time of exposure is based on the accumulated dose received in the image producing element. The phototimer acts to terminate the radiation from the x-ray generator typically after about 1 msec to 150 msec. The absorptivness or transparency of the subject's body tissues are factors that can affect the length of the exposure time. That is, for a particular dose setting, a thicker body part will have a longer exposure time than a thinner body part, and bone has a longer exposure time than soft tissues.

Phototimed exposure is employed in digital subtractive angiography (DSA) where a sequence of exposures are acquired serially. Typical acquisition rates can be one to two frames per second, with the sequence containing from ten to forty exposures.

Higher quality images can be acquired if the density of each image is kept constant over an entire sequence. Variation of exposure time from frame to frame, which occurs in phototimed DSA, can lead to reduced image quality.

In DSA, an opacifying agent or contrast agent (typically a compound of iodine) which is a strong absorber of X-rays is injected into the patient, and the sequence of X-ray images is acquired as the contrast agent courses through the subject's blood vessels. The contrast agent attenuates X-rays to a larger extent than the surrounding tissues, and permits the blood vessels to be distinguished. In DSA, the first few images are acquired without contrast agent in the vessel. Then the amount of contrast agent builds up, making the vessel more and more opaque. After maximum opacity, the amount of contrast agent subsides. The first few images, where there is no or little contrast agent present, serve as mask images, and can be subtracted from subsequent images to subtract out any tissues other than the vessels, i.e., bone and muscle. As the contrast agent enters the vessel, it causes the vessel to absorb more and more radiation making the vessel more opaque, but also lengthening the exposure time in the case of phototimed exposures. As a result, the length of the exposure is different from one image to another. Because exposure time is different, image density is different in the non-contrast areas (i.e., surrounding tissues). Thus when the images are subtracted from one another, the resulting image is of reduced quality.

Phototimed exposures may also yield inconsistent exposure times due to inherent tolerances and from the fact that they respond in direct proportion to the amount of light that reaches them.

In the case that a phototimer or similar device is not used, a fixed exposure technique can be used, where the technologist sets a predetermined fixed time on the console. With the fixed exposure technique the technologist selects current (ma) and voltage (KV) for the x-ray tube, based mostly on experience, and then shoots a scout image. The scout image is then evaluated in terms of its brightness and contrast. If the image is lacking these in areas, the current and voltage are adjusted and another scout images is taken. When the current and voltage are optimized and the scout image indicates good contrast, brightness, and density, the DSA examination can proceed.

The fixed exposure methodology is cumbersome because one or usually more than one scout images are required. This consumes time, and exposes the patients to additional radiation they would not otherwise receive.

Thus, between the two conventional techniques, a phototimer methodology will generally lead to poorer quality images than can be gained using a fixed exposure time technique, but the fixed time methodology is cumbersome and exposes the patient unnecessarily to additional radiation.

OBJECTS AND SUMMARY OF THE INVENTION

It is an object of this invention to provide a technique for obtaining a series of x-ray exposures of consistent high quality which will permit digital subtractive angiography or a similar subtractive technique to be carried out with reliable, optimal results.

It is another object of this invention to provide a multiple exposure technique which incorporates the advantages of automatic phototimer exposure control, but avoids its drawbacks.

It is a further object to provide simple, reliable circuitry to accomplish an automatic exposure control methodology which obtains the convenience of phototimer exposure control and the image quality of the fixed exposure technique.

It is a still further object to provide a methodology which minimizes the radiation dosage required to obtain a high quality series of images suitable for DSA.

According to an aspect of this invention, the automatic exposure control circuit is used in conjunction with a phototimer circuit that is incorporated into a fluoroscope imaging system. For the initial exposure of a series of x-ray exposures, or for some selected N exposures, the phototimer controls the actual exposure time of the x-ray generator. A pulse-width-modulated (PWM) signal from the x-ray generator control circuit represents the exposure time and is fed through an optoisolator to a control circuit within the automatic exposure circuit. Prior to the exposure, a preparatory signal resets this circuit. The control signal circuit enables a bank of read counters, which "read in" the input pulse signal by counting down clock pulses. The read counters are set to "FFFF" by a preset one-shot circuit prior to the commencement of the exposure. The read counter bank counts down until the exposure terminates. When this occurs, the count accumulated on the read counter bank is transferred over a counter bus to preset a second bank of counters, i.e., a write counter bank. At this time the read counter bank is disabled, and the accumulated count is held until the end of the series of exposures. This count represents the exposure time of a selected master x-ray exposure.

Upon the leading edge of the next PWM input pulse signal, the write counter bank counts up from the preset count until the counter bank reaches "FFFF". This duplicates the time of the master exposure. A series of output gates and drives then fires a relay circuit (e.g. a high speed reed switch) which terminates the exposure of the x-ray generator. The relay overrides the phototimer for the exposure termination function. For the rest of the exposures, the write counters are preset and act to count up from the preset count to "FFFF" so as to duplicate the master exposure time.

With this arrangement, exposure times from 1 msec to 150 msec can be captured and replicated, to a resolution of within about 0.1 msec. The automatic exposure control function can have a repetition rate from about 6 fps down to one frame each several seconds.

An exposure counter permits any of the first N exposures, as selected by the technologist, to be used as the master exposure from which all subsequent exposures in the series are timed.

This circuit employs commonly available digital circuit elements, which permits ease of fabrication and high repeatability of results. However, an equivalent linear circuit could be constructed following the principles of this invention, in which, e.g. a capacitor is charged at a fixed rate to a voltage that represents exposure time.

The above and many other objects, features, and advantages of this invention will become apparent from the ensuing description of a preferred embodiment, to be read in conjunction with the accompanying Drawing.

DETAILED DESCRIPTION OF THE PREFERRED EMBODIMENT

Figure 1:
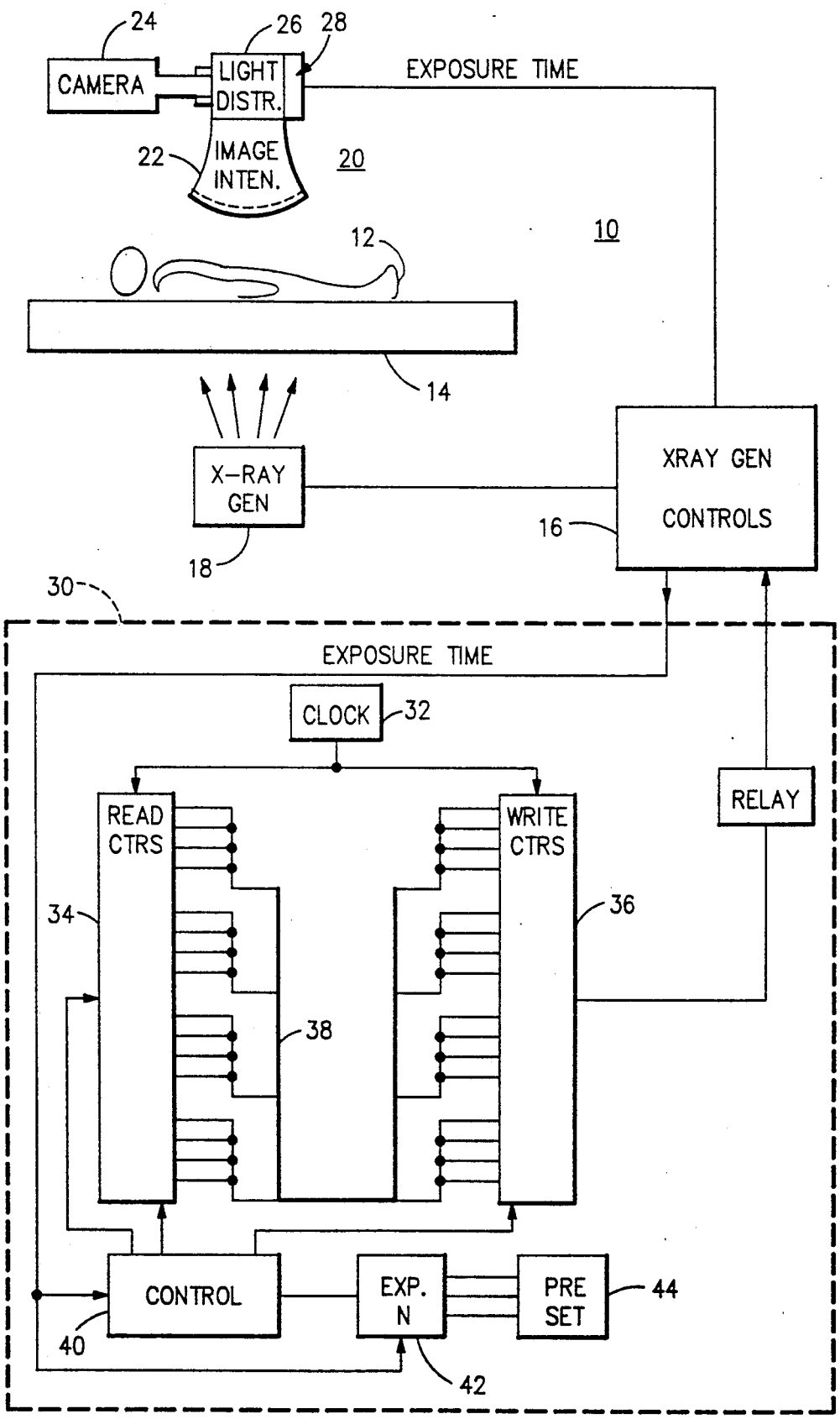
FIG. 1 is a schematic block diagram of the exposure control circuit of one embodiment of this invention.

With reference to the Drawing, and initially to FIG. 1, a typical x-ray apparatus or equivalent radiography system 10 is shown with a human subject 12 lying on a table 14 or bench. An xray generator 16 controls the current and voltage supplied to an xray tube 18 or similar device positioned beneath the table 14 to radiate through the subject to a fluoroscopic image gathering arrangement 20 that captures and stores a video image of the subject. The x-ray generator 16 includes control circuitry that controls the duration or on-time for the x-ray tube.

In this case the image gathering arrangement 20 is positioned above the subject 12 and includes an image intensifier tube 22 that forms an image based on the radiation that penetrates the subject and reaches the tube 22. A video camera 24 captures the image formed on the image intensifier tube 20, and this image is digitized and stored in a memory device (not shown). In a light distributor 26 there is a phototimer circuit 28 which accumulates light from the light distributor 26 for each exposure. When the total amount of light reaches some predetermined level, the phototimer circuit 28 sends a signal to the generator 16 to shut off the x-ray tube 18. The phototimer circuit 18 will produce an image acceptable in contrast and density.

In order to keep the contrast and density at the same level for a series of exposures, an automatic exposure control circuit 30 captures the duration of a predetermined exposure in a sequence thereof and repeats that for the remaining exposure in the sequence.

As shown schematically in broken lines in FIG. 1, the automatic exposure control circuit 30 has a clock circuit 32 generating clock pulses, here emitting clock pulses at a rate of about 250 KHz. A read counter bank 34 and a write counter bank 36 are each coupled to the read clock circuit to count the clock pulses beginning with the commencement of an exposure. A data bus 38 coupled to count outputs of the counter bank 34 transfers the contents thereof to inputs of the write counter bank 36.

A control circuit 40 receives the PWM exposure time signal from the x-ray generator 16 and controls the counting cycles of the counter banks 34 and 36.

An exposure counter circuit 42 counts leading edges of the exposure time signal to identify a selected exposure number N, the duration which is to be used as a master time that is to be repeated for subsequent exposures in the series. Here, a preset circuit 44 is selectable to choose the selected exposure number to actuate the automatic time control circuit 30 when that number of exposures is reached.

A relay circuit 46 is coupled to the write counter bank 36 and is actuated when the counter bank 36 reaches some predetermined count, e.g. FFFF. Then the relay circuit 46 signals to the x-ray generator control circuit 16 to shut off the x-ray tube 18.

At the commencement of a series of exposures the x-ray apparatus functions in a phototimer mode to expose the image intensifier tube to achieve optimal image quality. The exposure time signal stops the counter 42 until the selected exposure, e.g., first, second, third, etc. exposure is reached. At this point the read counter bank 34, which has been preset to a count of "FFFF," counts down using the clock pulses from the clock circuit 32 until the exposure terminates. Once this occurs, the read counter bank 34 is disabled and its accumulated count is transferred from its count output terminals, over the data bus 38, to respective count input terminates of the write counter bank 36. Upon the leading edge of the next exposure time signal, the control circuit 40 enables the write counter bank 36, and the latter count the clock pulses from that count until a count of FFFF is accumulated. This duplicates the exposure time of the selected master exposure that was read in to the read counter bank 34. At this point a high level is furnished to the relay circuit 46 which is then actuated and its output terminates the exposure of the x-ray generator.

This circuit can be powered with standard twelve volts or five volts dc. The input signals required from the x-ray generator are a PREP signal and an EXPOSURE signal.

Each exposure in the series subsequent to the selected or master exposure will have its duration timed by the exposure control circuit 30 to be equal to the time of the master exposure.

The directions of counting, i.e., "up" and "down" for the two counter banks 32, 36 are arbitrary, and the counter banks could be arranged to count "down" or "up," or the write counter bank could instead be supplied with the complement of the count stored in the read counter bank 34, in which case both counter banks could count up or down in the same sense. The important aspect of this circuit 30 is that the read counter bank 34 records the exposure time of the selected master exposure, and the write counter bank 36 duplicates this exposure time for all subsequent exposures in the series.

Figures 2, 2C:
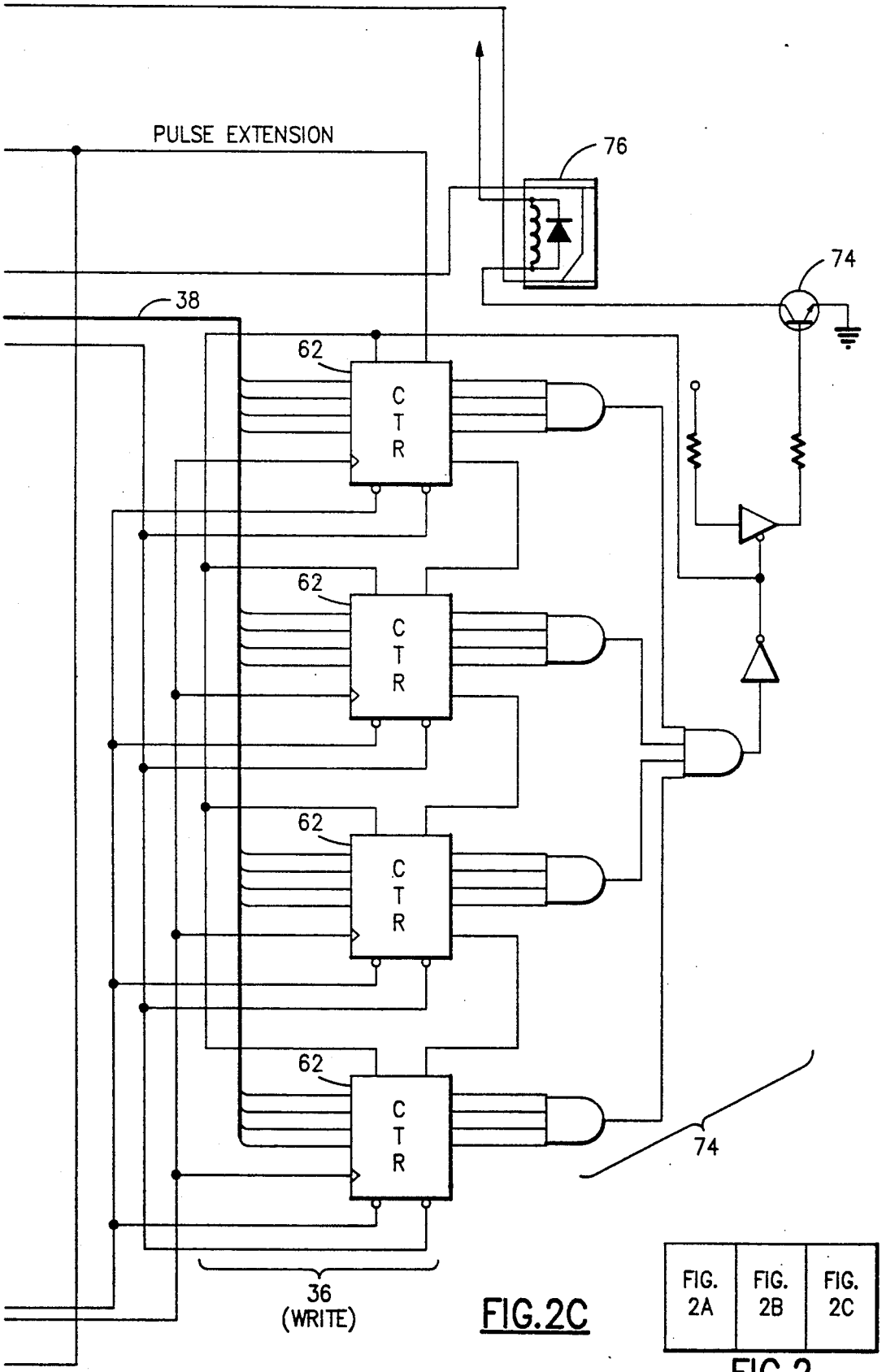
FIG. 2, which is composed of FIGS. 2A, 2B and 2C, is a more detailed circuit diagram of this embodiment.
Figure 2A:
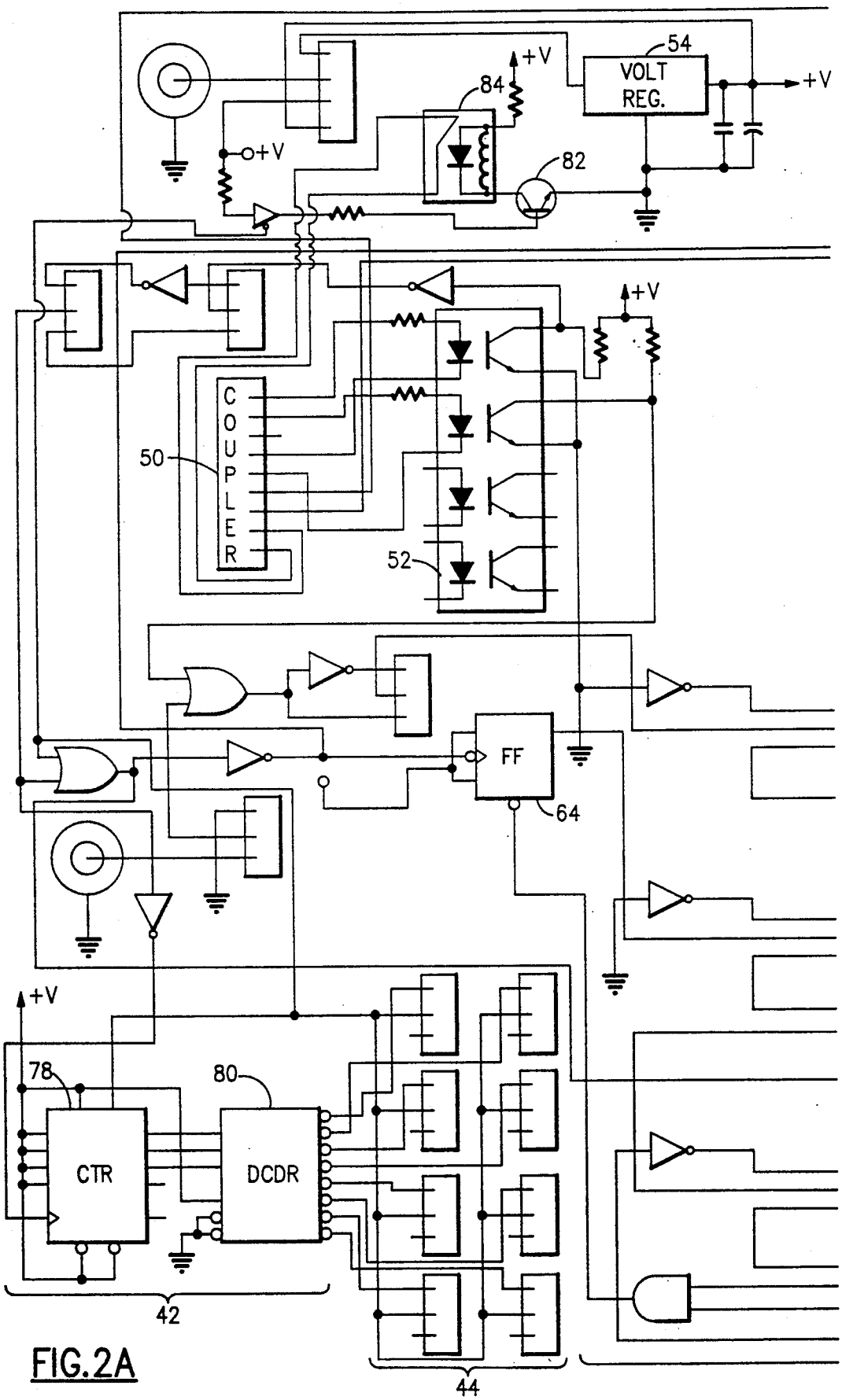
Figure 2B:
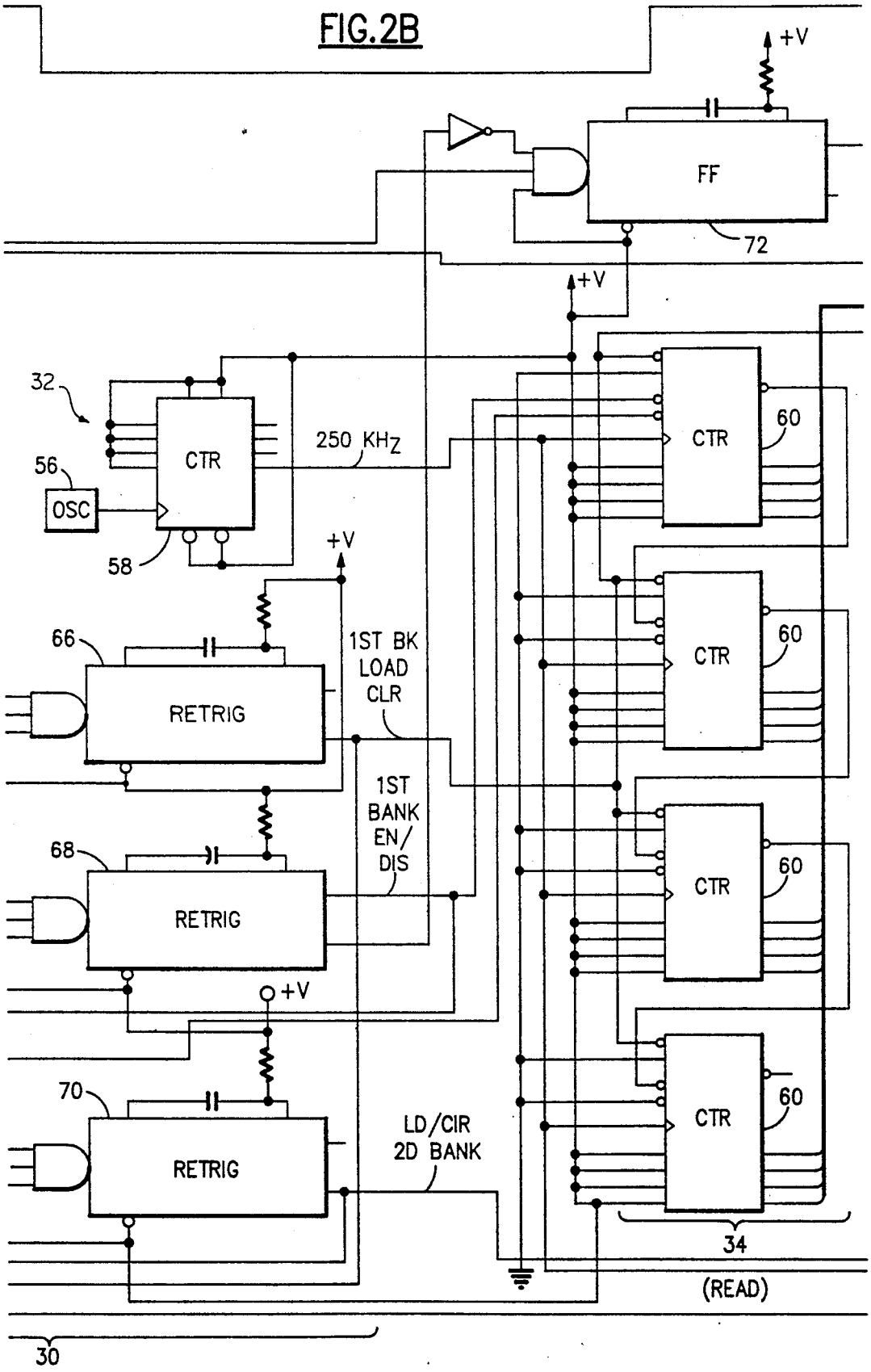

The circuitry of this embodiment of the invention is shown in more detail in FIG. 2 (formed of FIGS. 2A, 2B, and 2C).

As shown in FIG. 2 a connector 50 which is coupled to the xray generator control circuit 16 receives the PREP signal and the EXPOSURE signal which are fed through an optocoupler arrangement 52 to the exposure counter 42 and to various elements of the control circuit 30. As also shown, a controlled voltage regulator 54 provides a positive dc voltage +V to power the circuitry.

The clock circuit 32 includes a quartz oscillator 56 followed by a counter 58 arranged as a divider, the latter outputting pulses at a rate of 250 KHz.

The first, or read counter bank 34 is composed of four counters 60,60,60,60 arranged in cascade, while the second, or write counter bank 36 is likewise composed of four cascade-coupled counters 62,62,62,62.

In the control circuit, a flip-flop 64 is input with the EXPOSURE signal and provides a square wave output signal. The PREP signal is furnished from the optocoupler 52 to a retriggerable oneshot 66 which applies a LOAD signal to the read counters 60 to set each at a count of "F" (hex 15) and a clear signal to the write counters 62. The output of this one-shot also clears the flip-flop 64.

A second retriggerable one-shot 68, in response to the output of the flip-flop 64, sends an ENABLE signal to each of the read counters 60, so that they may commence counting down the clock pulses from the clock circuit 32. At the trailing edge of the EXPOSURE signal, the flip-flop 64 changes state, which causes the one-shot 68 to disable the counters 60. Thus, the count stored in the counter bank 34 corresponds to the number of clock pulses that occur during the master exposure.

A third retriggerable one-shot 70, actuated by the one-shot 68, is operative to load the write counters 62,62,62,62 with the count that is stored in the read counters 60,60,60,60, and a fourth retriggerable one-shot 72 generates a PULSE EXTENSION signal to the counters 62 of the second bank, and to the retriggerable 70 in response to the EXPOSURE signal during the time that the one-shot 68 is disabling the read counters 60,60,60,60. The PULSE EXTENSION signal enables the write counter bank 36 to commence counting the clock pulses up from the preset count loaded from the read counter bank 34. This ensures that the duration of all exposures is identical for the exposures subsequent to the master exposure.

An output gate assembly 74 here is composed of AND gates coupled to the outputs of the write counters 62,62,62,62 and this assembly fires a high level only when the counter bank 36 attains a predetermined count, here FFFF. This level actuates a transistor 76 which, in turn, powers a high speed reed-switch type relay 77. The latter then is operative to terminate the exposure from the xray tube 18.

The exposure counter 42 is here formed of a four-bit counter 78 that is fed with falling edges of the EXPOSURE signal from the optocoupler 52. The outputs of the counter 78 are coupled to inputs of a binary decoder 80, whose outputs are coupled to the exposure preset 44, illustrated here as connector blocks each jumper-connected to a respective terminal of the decoder 80. In a practical realization, the preset could be a rotary selector switch. The preset 44 permits the technologist to select exposure number one to eight as the master exposure.

When the exposure counter 42 reaches the exposure number of the master exposure, the output of the counter 80 gates a transistor 82 that in turn closes a relay 84, whose outputs are coupled through the coupler 50 to the phototimer circuit. This circuit 82,84 signals the phototimer circuit to turn itself off once the master exposure pulse is captured. This ensures that the exposure time will be determined by the captured master exposure time, even if the phototimer exposure time for a subsequent exposure would be less, for example for after the contrast fluid has dissipated.

Figure 3:
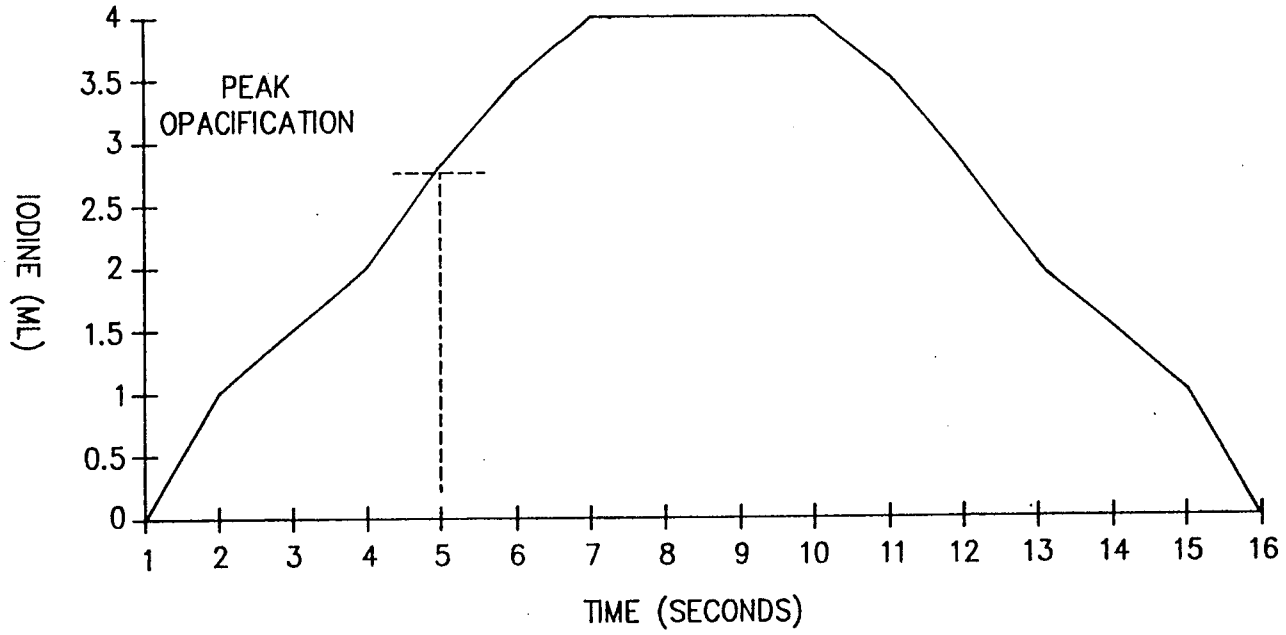
FIG. 3 is a graph showing generally the change in x-ray opacity over time for an iodine contrast medium in the vasculature of a human subject.

As shown in FIG. 3, in practice a contrast agent (here an iodine compound) gradually flows into the patient's blood vessels in the target area, so there is a gradual change in opacity of the subject for x-rays. Here, for an injection of 4 ml, the opacity of the subject's vasculature builds up to a maximum, occurring about seven seconds after injection. The iodine compound contrasts agent remains present at peak opacification for a time, and then gradually flows out from the target area. The contrast agent is eliminated here in about sixteen seconds. The rates and degree of opacifaction can vary from one patient to another.

Relative opacity from one exposure to another effects the exposure time as governed by the phototimer circuit, as it takes longer for the same degree of radiation to penetrate a greater amount of the contrast material to the image intensifier 22. Therefore, each exposure in the series, using only the phototimer, would have a different respective exposure time. The images of the surrounding tissues, i.e., non vasculature bone or muscle will vary in contrast and brightness or density from one exposure to the next. surrounding tissues, i.e., non vasculature bone or muscle will vary in contrast and brightness or density from one exposure to the next.

The above variance in exposure density can be avoided with this invention, for example, by setting the exposure counter 42 and preset 44 to capture, e.g. the fifth image. If we assume one frame per second, the master frame would have its exposure governed by the opacification condition indicated at the dash line in FIG. 3. All subsequent exposures, i.e., image six and following, would have an identical exposure time, and the only changes in contrast or density would be attributed to the subjects vasculature where the amount of contrast material is changing.

The acquired images have substantially identical contrast and brightness for the surrounding tissues, with only the contrast tissues, e.g. vasculature, varying in density. These images can be combined digitally to produce subtractive images of the highest quality.

While this invention has been described in detail with reference to an illustrative embodiment, it should be understood that the invention is not limited to that embodiment. Rather, many modifications and variations will present themselves to those skilled in the art without departing from the scope and spirit of this invention as defined in the appended claims.

What is claimed is:

1. An exposure control circuit for capturing an optimal exposure time for a radiographic exposure in a series of radiographic exposures and repeating that time for subsequent radiographic exposures in the series, for use in connection with a radiographic system in which a controlled radiation source generates radiation that passes through a subject's tissues to expose an image gathering device, and in which a controller automatically commences the series of exposures at spaced time intervals and phototimer means for automatically terminating the generation of radiation by said source for a given radiographic exposure in said series in response to the amount of radiation detected by the image gathering device for said given exposure;

wherein said exposure control circuit comprises timing signal generating means producing a timing signal at a predetermined rate;

read accumulator means receiving said timing signal over the exposure time for said given exposure and accumulating a value corresponding to the exposure time of said given exposure including means for storing the value accumulated by said read accumulator means for a selected one of said series of exposures;

write accumulator means for accumulating said timing signal for each of said subsequent exposures beginning with the commencement of each of said exposures, and comparing the value accumulated therein with said stored value;

and output circuit means having an input coupled to an output of said write accumulator means and having an output coupled to the controller of said radiographic system for terminating each of said subsequent exposures upon said write accumulator attaining the accumulated value corresponding to said stored value.

2. The exposure control circuit of claim 1 wherein said timing signal generating means includes a clock pulse generator producing clock pulses at a predetermined rate.

3. The exposure control circuit of claim 2 wherein said read accumulator means includes a first counter bank operative to count said clock pulses and means to preset the counter bank at the commencement of a given exposure in said series, and means enabling the first counter bank to begin counting at the commencement of said given exposure.

4. The exposure control circuit of claim 3 wherein said write accumulator means includes a second counter bank coupled to said timing signal generating means to commence counting said clock pulse at the commencement of each of said subsequent exposures in said series, and means loading the second counter bank with the accumulated count in said first counter bank prior to counting of the clock pulses in the second counter bank.

5. The exposure control circuit of claim 4, further comprising control circuit means coupled to an output of said radiographic system controller and having a plurality of retriggerable one-shots, a first one of which is triggered at the beginning of each series of exposures to load said first counter bank and clear said second counter bank; a second of which is triggered at the occurrence of said selected exposure to disable the first counter bank; and a third of which is triggered by the second retriggerable one-shot to load the count of said first counter bank into said second counter bank.

6. The exposure control circuit of claim 5, further comprising exposure counter means including an exposure counter having a count input coupled to said radiographic system controller to count occurrences of the exposures in said series, and having an accumulated count output; preset means for selecting a given number N of exposures at which to capture the exposure time; and decoder means coupled to said exposure counter and to said preset means to produce a capture signal upon the occurrence of said N exposures, said capture signal being fed to said second retriggerable oneshot.

7. Exposure control circuit for capturing an optimal exposure time for a radiographic exposure in a series of exposures and repeating that time for subsequent radiographic exposures in the series, for use in connection with a radiographic system in which a controlled radiation source generates radiation that passes through a subject's tissues to expose an image gathering device, and in which a controller automatically conducts the series of exposures at spaced time intervals and phototimer means automatically terminates the generation of radiation by said source for a given radiographic exposure in said series in response to the amount of radiation detected by the image gathering device for said given exposure;

wherein said exposure control circuit comprises a clock circuit generating clock pulses at a predetermined rate;

a read counter bank operative to count said clock pulses during a radiographic exposure and having a clock input, at least one control input, and a plurality of count inputs;

a write counter bank operative to count said clock pulses beginning with the commencement of each of said subsequent exposures, and having a clock input, at least one control input, and an output generating an output signal when said write counter bank reaches a predetermined count, and a plurality of count inputs;

data path means for transferring the accumulated count for the count outputs of the read counter bank to the count inputs of the write counter bank;

output relay means having an input coupled to the write counter bank output and an output coupled to said radiographic system controller to control the length of exposure time for said subsequent exposures;

control circuit means having an input coupled to said radiographic system controller and control outputs connected to the control inputs of said read counter bank and said write counter bank for selectively enabling and disabling the read counter bank, resetting the read counter bank, and loading the count of said read counter bank into said write counter bank;

and exposure counter means presetable for a given exposure number N in said series and including an input coupled to said radiographic system controller and an output coupled to said control circuit means to provide an exposure control signal thereto upon occurrence of the Nth exposure of said series, said control circuit means then being operative to hold the count of said read counter bank and transfer the count accumulated thereon to said write counter bank and to enable said write counter bank to count said clock pulses beginning with the commencement of each said subsequent exposure so that all of said subsequent exposures are of a time duration governed by said accumulated count.

* * * * *